US005580604A

United States Patent [19]

Chang

[11] Patent Number: 5,580,604

[45] Date of Patent: Dec. 3, 1996

[54] METHOD OF MANUFACTURING A HOT-STAMPED DECAL

[76] Inventor: Chih C. Chang, 2F, 903, Shiang Sin South Road, Taichung, Taiwan

[21] Appl. No.: 399,172

[22] Filed: Mar. 6, 1995

[51] Int. Cl.[6] ..... B41M 3/12

[52] U.S. Cl. ..... 427/147; 427/207.1; 427/259; 427/261; 427/264; 427/265; 427/272; 427/282; 427/385.5; 427/407; 427/412.5; 216/4; 216/32; 216/33; 216/40; 216/50; 216/51; 216/95; 156/277

[58] Field of Search ..... 427/147, 207.1, 427/272, 261, 282, 264, 265, 385.5, 404, 259, 412.5; 216/4, 32, 33, 40, 50, 51, 95; 156/277

[56] References Cited

U.S. PATENT DOCUMENTS 4,012,552 3/1977 Watts ..... 427/147
4,490,409 12/1984 Nablo ..... 427/147
4,687,680 8/1987 Narvi ..... 427/147
5,116,459 5/1992 Kordus et al. ..... 216/20

FOREIGN PATENT DOCUMENTS 7900103 3/1979 WIPO ..... 427/147

*Primary Examiner*—Janyce Bell

[57] ABSTRACT

A method of manufacturing a hot-stamped decal includes step A: preparing a metalized polyester film including a metalized layer disposed on a top surface thereof, a clear polyester sheet disposed to an under side of the metalized layer, an adhesive layer disposed to an under side of the clear polyester sheet and a release sheet disposed to an under side of the adhesive layer, step B: applying a printing process on the metalized layer to form a mark thereon composed of a printed ink layer, step C: preparing an alkaline corrosive solution, step D: flushing the top surface of the metalized layer with the alkaline solution composed of water and NaOH to the top surface of the metalized layer to corrode the metalized layer not covered by the printing ink layer, step E: flushing the top surface of the metalized layer with water and step F: drying the hot-stamped decal.

3 Claims, 4 Drawing Sheets

METHOD OF MANUFACTURING A HOT-STAMPED DECAL

BACKGROUND OF THE INVENTION

The present invention relates to a method of manufacturing a hot-stamped decal and more particularly, to a method of applying a printing process executed on a top surface of a metalized polyester and then mopping the top surface with an alkaline corrosive solution, washing the surface with water and drying the surface so as to get a feature of manufacturing the hot-stamped decal with a short time and using no acid solution.

FIG. 1 shows, a conventional hot-stamped decal, wherein an embossed plate 20 made of zinc is prepared and in which a desired mark is defined, the embossed plate 20 being covered with a hot stamped-film 21 and a heat pressing process executed thereto to form the mark on the hot-stamped film 21, a clear polyester sheet 22 connected to the hot-stamped film 21 such that the mark can be seen through the clear polyester sheet 22. The hot-stamped decal is used by removing the clear polyester sheet 22 from the hot-stamped film 21 and adheres the hot-stamped film 21 to a desired object.

However, the embossed plate made of zinc is very expensive and the changes of temperature tend to alter its size, so that it cannot produce an exquisite hot-stamped decal. Furthermore, it is difficult to include multiply colors in the hot-stamped film and thus a complicated process is needed which thereby restricts its usage.

Another method of manufacturing a hot-stamped decal is shown in FIGS. 2 and 3 and includes the following steps:

a. to prepare a metalized polyester film 30 which comprises a metalized layer 31 disposed on a top surface thereof, a clear polyester sheet 32 disposed to an under side of the metalized polyester film 31, an adhesive layer 33 disposed to an under side of the clear polyester sheet 32 and a release sheet 34 disposed to an under side of the adhesive layer 33;

b. to execute a printing process on a top surface of the metalized layer 11 to form a mark thereon composed of a printed ink layer 35;

c. to mop the printed ink layer 35 with an alkaline corrosive solution to corrode the top surface of the metalized layer 31 not covered by the printed ink layer 35;

d. a neutralization reaction is executed by mopping an acid solution on the metalized layer 31 after the metalized layer 31 is corroded completely to stop the corrosion action;

e. to clean the alkaline solution and the acid solution rest on the top surface of the metalized layer 31 by using a wet cloth to mope thereon, and f. to dry the top surface of the metalized layer 31.

However, such a method has an unstable factor in step d in which the acid solution has to be prepared to perform a desired neutralization reaction with the alkaline solution otherwise the printed ink layer 35 may be corroded or the top surface of the metalized layer 31 may be over corroded, furthermore, the mopping processes in steps c, d and e take a lot of time by manufacturers and the changes of temperature during step d tend to alter the size of the mark.

The present invention intends to provide an easier method to produce a hot-stamped decal to mitigate and/or obviate the above-mentioned problems.

SUMMARY OF THE INVENTION

The present invention provides a method of manufacturing a hot-stamped decal comprising steps A to F, the step A is to prepare a metalized polyester film including a metalized layer disposed on a top surface thereof, a clear polyester sheet disposed to an under side of the metalized layer, an adhesive layer disposed to an under side of the clear polyester sheet and a release sheet disposed to an under side of the adhesive layer, the step B is to apply a printing process on the metalized layer to form a mark thereon composed of a printed ink layer, the step C is to prepare an alkaline corrosive solution, the step D is to flush the top surface of the metalized layer with the alkaline solution composed of water and NaOH to the top surface of the metalized layer to corrode the metalized layer not covered by the printing ink layer, the step E is to flush the top surface of the metalized layer with water and the step F is to dry the hot-stamped decal.

It is an object of the present invention to provide a method to manufacture a hot-stamped decal with no acid solution used.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
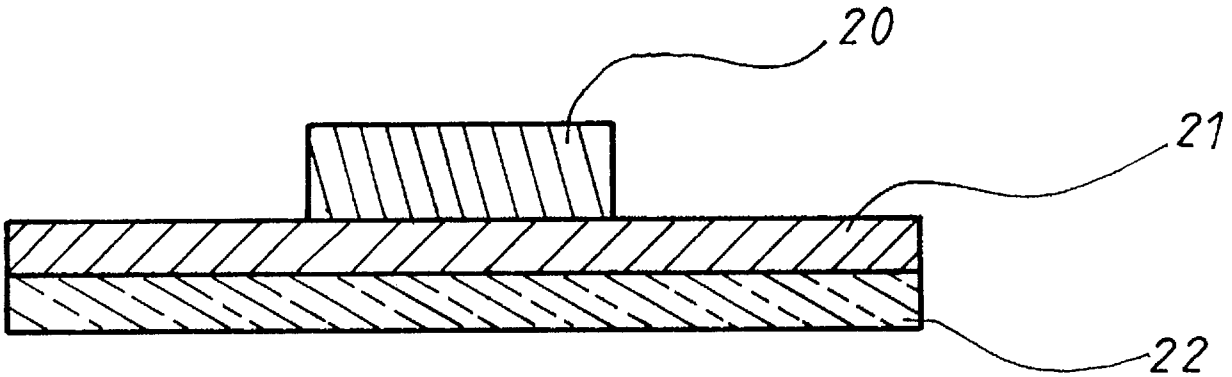
FIG 1 PRIOR ART
FIG. 1 is a side view in section of a conventional hot-stamped decal.
Figure 2:
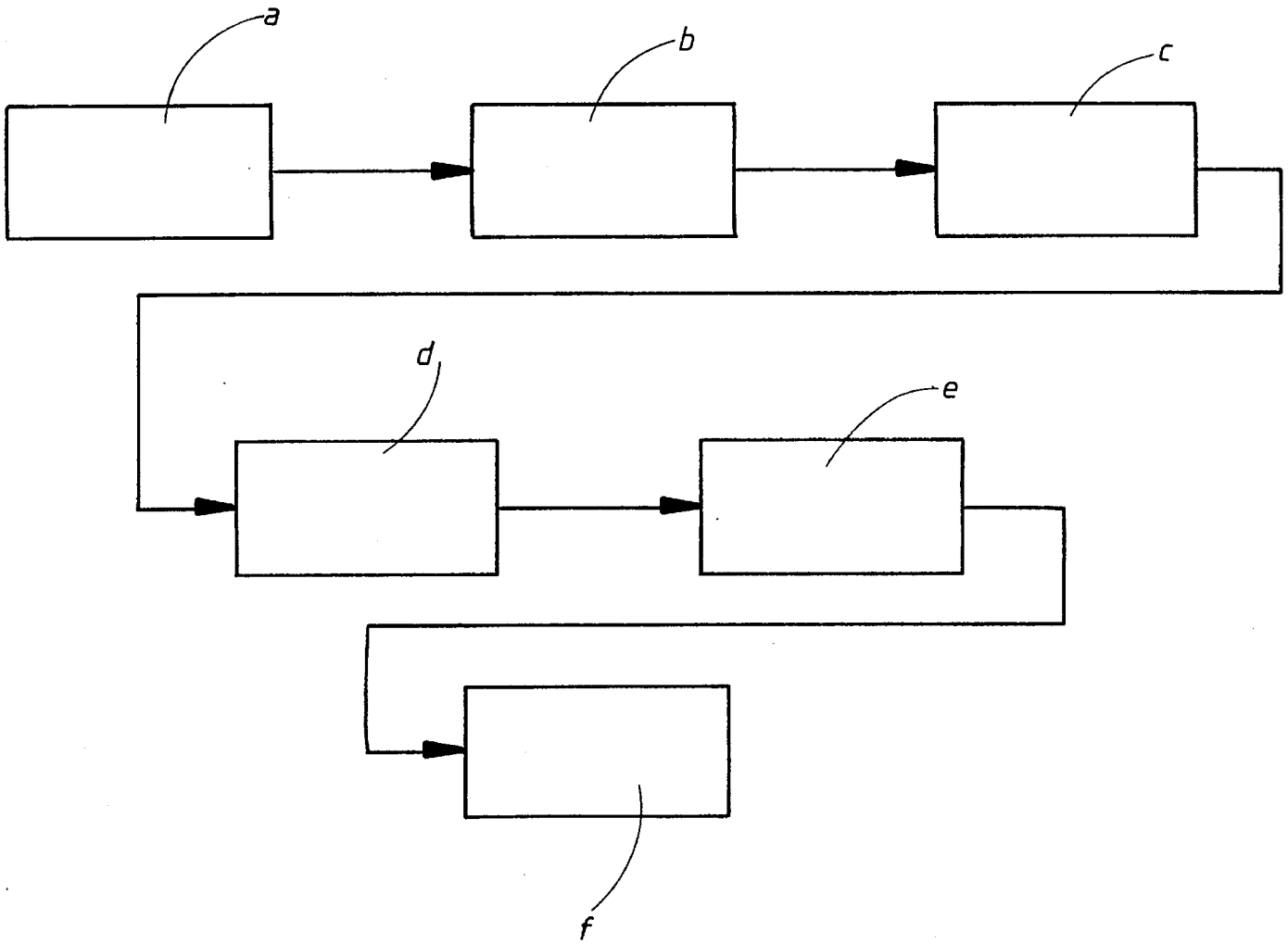
FIG 2 PRIOR ART
FIG. 2 is flow chart of a method of manufacturing another kind of hot-stamped decal.
Figure 3:
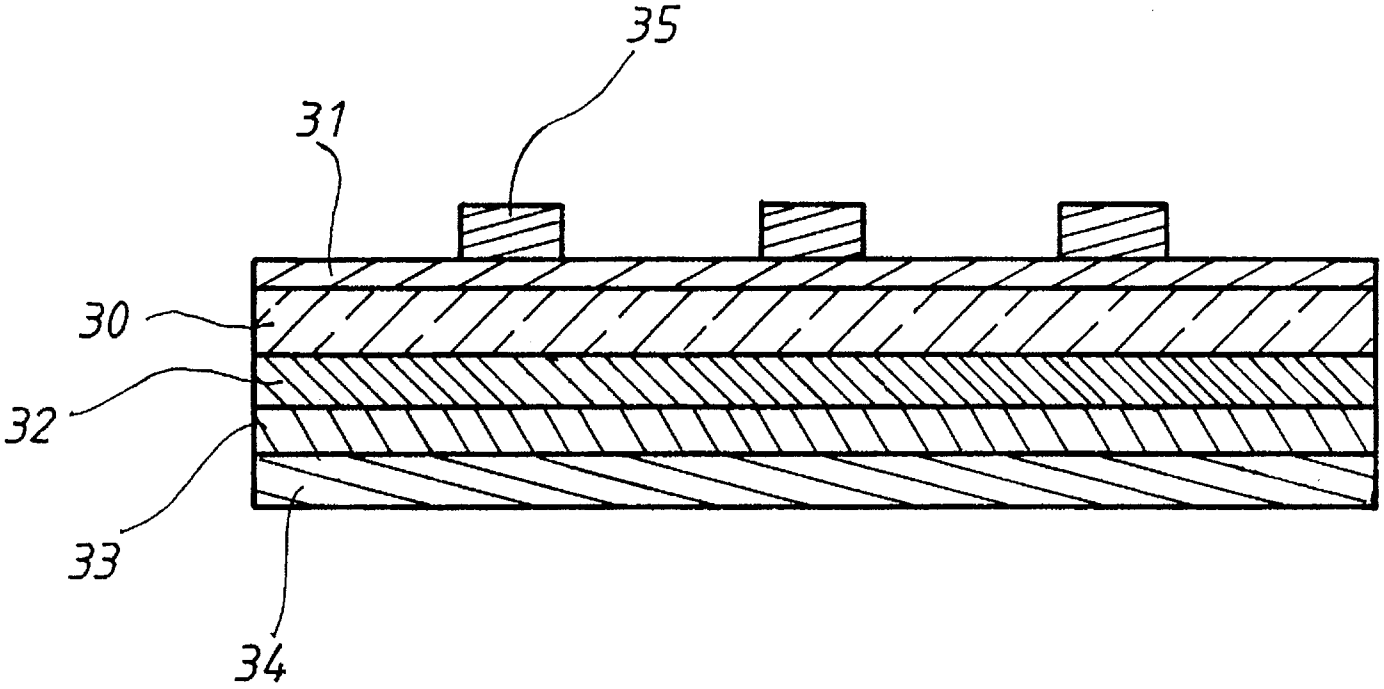
FIG 3 PRIOR ART
FIG. 3 is a side elevational view in section of the hot-stamped decal manufactured by the method shown in FIG. 2.
Figure 4:
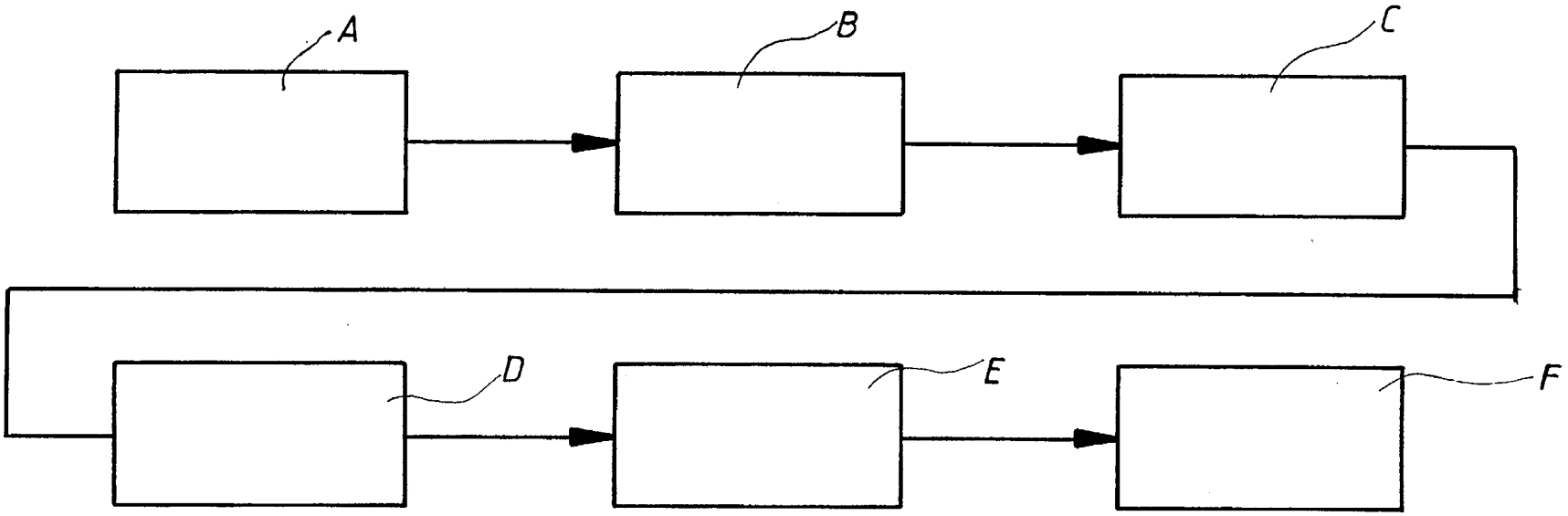
FIG. 4 is a flow chart of a method of manufacturing a hot-stamped decal in accordance with the present invention.

Referring to FIG. 4, a method of manufacturing a hot-stamped decal in accordance with the present invention generally includes the following steps:

A. preparing a metalized polyester film comprising a metalized layer disposed on a top surface thereof, a clear polyester sheet disposed to an under side of the metalized layer, an adhesive layer disposed to an under side of the clear polyester sheet and a release sheet disposed to an under side of the adhesive layer;

B. applying a printing process on the metalized layer to form a mark thereon composed of a printed ink layer;

C. preparing an alkaline corrosive solution composed of 75% water and 25% NaOH;

D. flushing the top surface of the metalized layer with the alkaline solution composed of water and NaOH to the top surface of the metalized layer to corrode the metalized layer not covered by the printing ink layer, wherein a preferable surrounding temperature is 35 degree Celsius;

E. flushing the top surface of the metalized layer with water; and

F. drying the hot-stamped decal.

Accordingly, the present invention provides a method which requires no acid solution during the steps of manufacturing the hot-stamped decal and therefore has a feature of manufacturing the hot-stamped decal more easier than the prior arts.

Although the invention has been; explained in relation to its preferred embodiment, it is to be understood that many other possible modifications and variations can be made without departing from the spirit and scope of the invention as hereinafter claimed.

I claim:

1. A method of manufacturing a hot-stamped decal and comprising the following steps:

A. preparing a metalized polyester film comprising a metalized layer disposed on a top surface thereof, a clear polyester sheet disposed to an under side of the metalized layer, an adhesive layer disposed to an under side of the clear polyester sheet and a release sheet disposed to an under side of the adhesive layer;

B. applying a printing process on the metalized layer to form a mark thereon composed of a printed ink layer;

C. preparing an alkaline corrosive solution;

D. flushing the top surface of the metalized layer with the alkaline solution composed of water and NaOH to the top surface of the metalized layer to corrode the metalized layer not covered by the printing ink layer;

E. flushing the top surface of the metalized layer with water; and

F. drying the hot-stamped decal.

2. The method as claimed in claim 1 wherein the alkaline solution is composed of 75% water and 25% NaOH.

3. The method as claimed in claim 2 wherein the solution used in step d has a surrounding temperature of 35 degrees Celsius.

* * * * *